US009905186B2

(12) United States Patent
Zhao et al.

(10) Patent No.: US 9,905,186 B2
(45) Date of Patent: Feb. 27, 2018

(54) LIQUID CRYSTAL PANEL AND DRIVING METHOD THEREOF AND LIQUID CRYSTAL DISPLAY

(71) Applicant: Shenzhen China Star Optoelectronics Technology Co., Ltd., Shenzhen, Guangdong (CN)

(72) Inventors: Wenqin Zhao, Guangdong (CN); Yu-yeh Chen, Guangdong (CN); Xiaoping Tan, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 606 days.

(21) Appl. No.: 14/426,757

(22) PCT Filed: Nov. 18, 2014

(86) PCT No.: PCT/CN2014/091339
§ 371 (c)(1),
(2) Date: Mar. 9, 2015

(87) PCT Pub. No.: WO2016/070461
PCT Pub. Date: May 12, 2016

(65) Prior Publication Data

US 2016/0335977 A1 Nov. 17, 2016

(30) Foreign Application Priority Data

Nov. 7, 2014 (CN) ..... 2014 1 0624121

(51) Int. Cl.
*G09G 3/36* (2006.01)

(52) U.S. Cl.
CPC ..... *G09G 3/3696* (2013.01); *G09G 3/3677* (2013.01); *G09G 3/3688* (2013.01);
(Continued)

(58) Field of Classification Search
None
See application file for complete search history.

(56) References Cited

U.S. PATENT DOCUMENTS

2008/0291190 A1* 11/2008 Kim ..... G09G 3/3648 345/211
2008/0303809 A1* 12/2008 Lee ..... G09G 3/3648 345/215

(Continued)

FOREIGN PATENT DOCUMENTS

CN 101465096 A 6/2009
CN 102034440 A 4/2011

*Primary Examiner* — Jennifer Mehmood
*Assistant Examiner* — Krishna P Neupane
(74) *Attorney, Agent, or Firm* — Andrew C. Cheng

(57) ABSTRACT

The present invention discloses a liquid crystal panel. The panel includes a display area that includes an array of pixel units formed thereon, a source controller, a gamma voltage control section, a gate controller, a chamfer voltage control section, and an image inspection section. The image inspection section classifies images into n classes according to ranking of grey level. The chamfer voltage control section is operated in response to the class of an image to control one of the n chamfer voltage circuits to supply the chamfer voltage to the gate controller and the gamma voltage control section is operated in responses to the class of the image to control one of the n gamma voltage circuits to supply the gamma voltage to the source controller, where n is an integer greater than 1. The present invention also discloses a driving method for the liquid crystal panel and a liquid crystal display including the liquid crystal panel. The liquid crystal panel provided by the present invention allows for reduction of a feed-through voltage ΔV and at the same time reducing the difference of ΔV between high and low grey levels so as to enhance the displaying quality of the liquid crystal panel.

18 Claims, 5 Drawing Sheets

(52) U.S. Cl.
CPC ... *G09G 2310/06* (2013.01); *G09G 2310/066* (2013.01); *G09G 2320/0219* (2013.01); *G09G 2320/0247* (2013.01); *G09G 2320/0276* (2013.01)

(56) References Cited

U.S. PATENT DOCUMENTS

2009/0262146 A1* 10/2009 Hashimoto ..... G09G 3/3688 345/690
2010/0033475 A1* 2/2010 Choi ..... G09G 3/3648 345/214

* cited by examiner

LIQUID CRYSTAL PANEL AND DRIVING METHOD THEREOF AND LIQUID CRYSTAL DISPLAY

BACKGROUND OF THE INVENTION

1. Field of the Invention

The present invention relates to the technical field of liquid crystal displays, and in particular to a liquid crystal panel and a driving method thereof, and also relates to a liquid crystal display comprising the liquid crystal panel.

2. The Related Arts

A liquid crystal display (LCD) is a flat and ultra-thin display device, which is composed of a predetermined number of color or monochromic pixels to be placed in front of a light source or a reflection surface. The liquid crystal display has extremely low power consumption and possesses various advantages, such as high image quality, small volume, and light weight, and are thus very favorite by the public, making it the mainstream of display devices. The liquid crystal displays that are currently available are primarily thin-film transistor (TFT) liquid crystal displays. A liquid crystal panel is a major component of the liquid crystal display.

FIG. 1 is a schematic view showing the structure of a conventional liquid crystal panel. As shown in FIG. 1, the liquid crystal panel comprises a display area 1 comprising an array of pixel units px arranged therein, a source controller 2, a gate controller 3, a gamma voltage control section 4, and a chamfer voltage control section 5, wherein the chamfer voltage control section 5 supplies a chamfer voltage to the gate controller 4 to allow the gate controller 4 to generate a corresponding scan signal supplied to the pixel units px. The gamma voltage control section 3 supply a gamma voltage to the source controller 2 to allow the source controller 2 to generate a corresponding data signal supplied to the pixel units px. The pixel units px of the liquid crystal panel comprises a thin-film transistor and an equivalent circuit diagram of a pixel unit px is illustrated in FIG. 2. As shown in FIG. 2, in the drawing, Vgh indicates a turn-on voltage that the gate controller 4 supplies to the thin-film transistor; Vgl indicates a turn-off voltage that the gate controller 4 supplies to the thin-film transistor; Cgs indicates a parasitic capacitor; Cst indicates a storage capacitor; and Ccl indicates a liquid crystal capacitor. Due to the existence of the parasitic capacitor Cgs, repeatedly turning on and off the thin-film transistor leads to the generation of a feed-through voltage ΔV, wherein $\Delta V=(Vgh-Vgl)Cgs/(Cgs+Ccl+Cst)$. The existence of ΔV affects the displaying quality of the liquid crystal panel, such as generating a flicker phenomenon. The liquid crystal panel discussed above uses the chamfer voltage control section 5 to generate a chamfer voltage supplied to the gate controller 4 and the scan signal supplied from the gate controller 4 to the thin-film transistor has a waveform illustrated in FIG. 3. By decreasing the difference between the turn-on voltage Vgh and the turn-off voltage Vgl, the purpose of reducing ΔV may be achieved.

In the liquid crystal panel provided above, the chamfer voltage control section 5 supplies a fixed chamfer voltage. In other words, the difference between the turn-on voltage Vgh and the turn-off voltage Vgl is set constant for image signals of different grey levels. However, for different grey levels, the liquid crystal capacitor Clc is different and ΔV increases with the increase of the grey level. The relationship between ΔV and grey level is illustrated in FIG. 4. The greater the difference of ΔV between high and low grey levels is, the more unbalanced the common voltage Vcom of the pixel unit px will be and the worse the displaying performance of the liquid crystal panel will be.

SUMMARY OF THE INVENTION

In view of the shortcomings of the known techniques, an object of the present invention is to provide a liquid crystal panel and the liquid crystal panel allows for reduction of a feed-through voltage ΔV, while at the same time reducing the difference of ΔV between high and low grey levels and enhancing the displaying quality of the liquid crystal panel.

To achieve the above object, the present invention provides the following technical solution:

A liquid crystal panel, comprising:

a display area, which comprises an array of pixel units formed thereon;

a gate controller, which supplies a scan signal to the pixel units;

a source controller, which supplies a data signal to the pixel units;

a chamfer voltage control section, which comprises n chamfer voltage circuits to supply a chamfer voltage to the gate controller to make the gate controller generating the scan signal corresponding thereto;

a gamma voltage control section, which comprises n gamma voltage circuits to supply a gamma voltage to the gate controller to make the gate controller generating the data signal corresponding thereto;

the liquid crystal panel further comprising an image inspection section, where the image inspection section, in response to an image signal received thereby, classifies images into n classes according to ranking of grey level of the image signal;

wherein when the image inspection section inspects and identifies an image belongs to a mth class, the chamfer voltage control section is operated to have a mth one of the chamfer voltage circuits supplying the chamfer voltage to the gate controller and the gamma voltage control section is operated to have a mth one of the gamma voltage circuits supplying the gamma voltage to the gate controller;

where n is an integer greater than 1 and m=1, 2, . . . , n.

Wherein, when the grey level of the image signal inspected by the image inspection section is higher, the chamfer voltage supplied from the chamfer voltage control section is smaller.

Wherein, the chamfer voltage circuits comprise a 3-step circuit.

Wherein, the gamma voltage generated by the mth gamma voltage circuit is obtained through an adjustment made according to the chamfer voltage generated by the mth chamfer voltage circuit.

A driving method for the above-described liquid crystal panel comprises:

the image inspection section receiving the image signal and classifying images into n classes according to ranking of grey level of the image signal;

the chamfer voltage control section being operated according to the classification of an image to control one of the n chamfer voltage circuits to supply the chamfer voltage to the gate controller to make the gate controller generate the scan signal supplied to the pixel units; and the gamma voltage control section being operated according to the classification of the image to control one of the n gamma voltage circuits to supply the gamma voltage to the gate controller to make the gate controller generate the data signal supplied to the pixel units;

where n is an integer greater than 1.

Wherein, when the grey level of the image signal inspected by the image inspection section is higher, the chamfer voltage supplied from the chamfer voltage control section is smaller.

Wherein, the chamfer voltage circuits comprise a 3-step circuit.

Wherein, the n gamma voltage circuits are arranged to corresponding to the n chamfer voltage circuits in a one-to-one manner and the gamma voltage generated by each of the gamma voltage circuits is obtained through an adjustment made according to the chamfer voltage generated by the corresponding one of the chamfer voltage circuits.

Another aspect of the present invention is to provide a liquid crystal display, which comprises a liquid crystal panel and a backlight module. The liquid crystal panel is arranged opposite to the backlight module. The backlight module supplies displaying light to the liquid crystal panel to allow the liquid crystal panel to display an image. The liquid crystal panel adopted is the liquid crystal panel described above.

Compared to the prior art techniques, in the liquid crystal panel provided according to the present invention, classification is made according to ranking of grey level of images based on an inputted image signal and selection of corresponding chamfer voltages and gamma voltages is made according to the classes of the images so that while the feed-through voltage ΔV is reduced, the difference of ΔV between high and low grey levels can also be reduced so as to enhance the displaying quality of the liquid crystal panel.

DETAILED DESCRIPTION OF THE PREFERRED EMBODIMENTS

To make the object, technical solution, and advantages of the present invention more clearly understood, the present invention will be further expounded with reference to embodiments of the present invention, in combination with the attached drawings.

Figure 1:
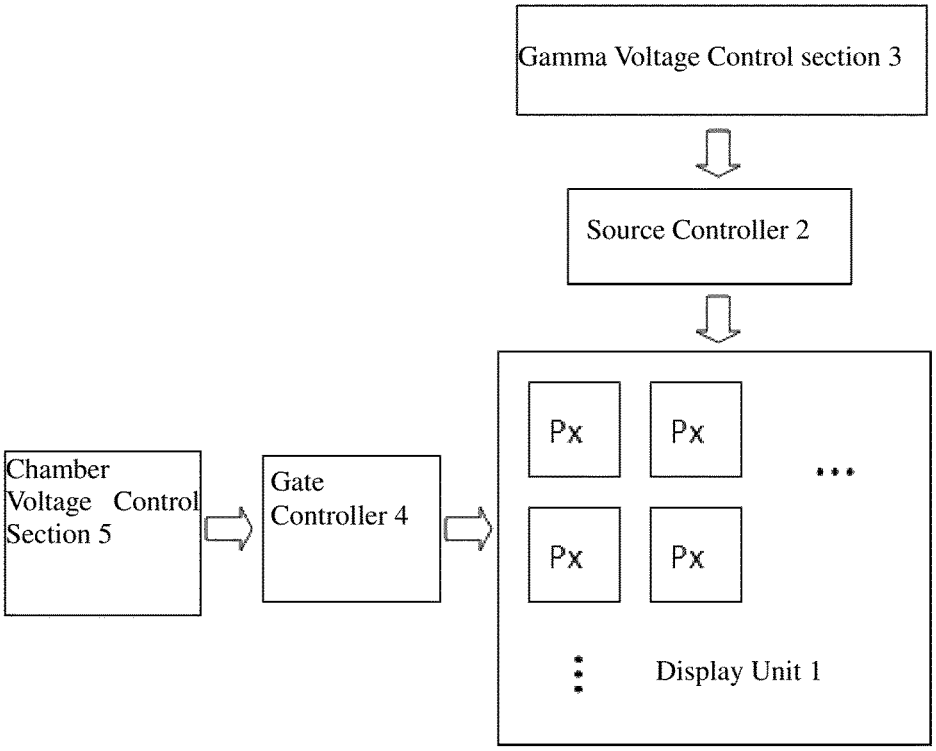
FIG. 1(prior art)
FIG. 1 is a schematic view showing the structure of a conventional liquid crystal panel.
Figure 2:
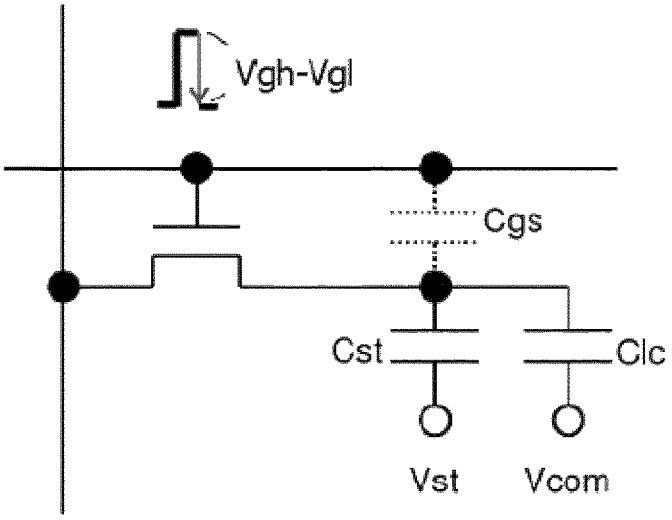
FIG. 2(prior art)
FIG. 2 shows an equivalent circuit diagram of a pixel unit px of the liquid crystal panel.
Figure 3:
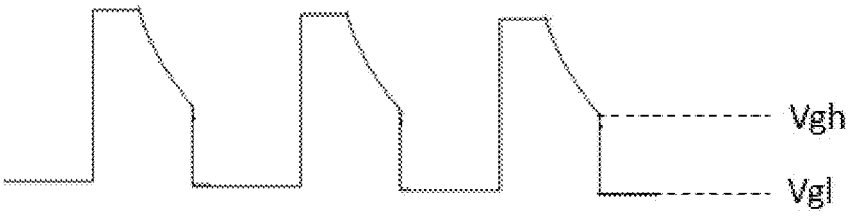
FIG. 3(prior art)
FIG. 3 shows a waveform diagram of a scan signal supplied from a gate controller of the prior art.
Figure 4:
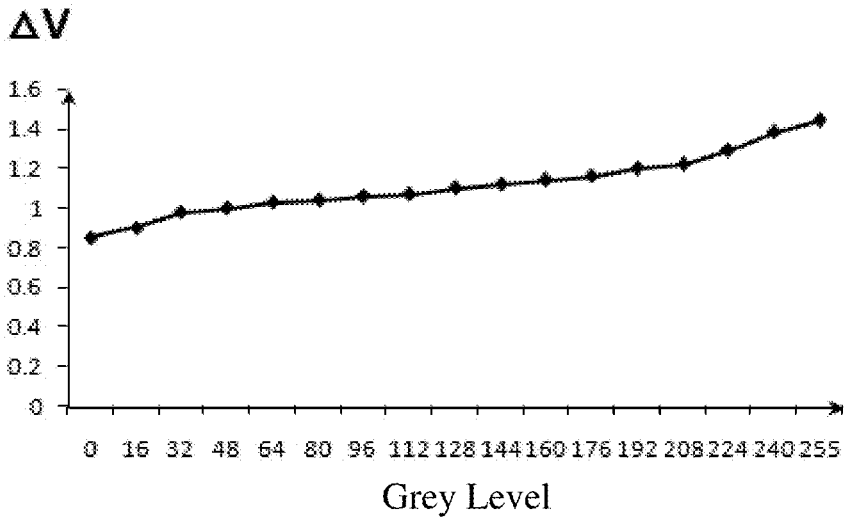
FIG. 4(prior art)
FIG. 4 shows a relationship between a feed-through voltage ΔV and grey level of the prior art.
Figure 5:
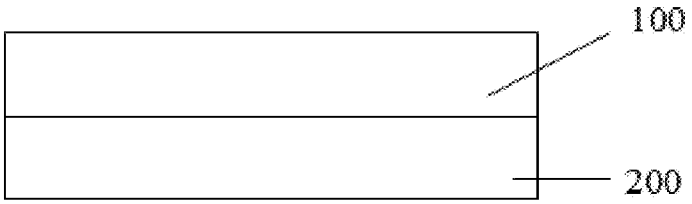
FIG. 5 is a schematic view showing the structure of a liquid crystal display provided according to an embodiment of the present invention.

As shown in FIG. 5, a liquid crystal display provided according to the instant embodiment comprises a liquid crystal panel 100 and a backlight module 200. The liquid crystal panel 100 is arranged opposite to the backlight module 200. The backlight module 200 supplies displaying light to the liquid crystal panel 100 to allow the liquid crystal panel 100 to display an image.

Figure 6:
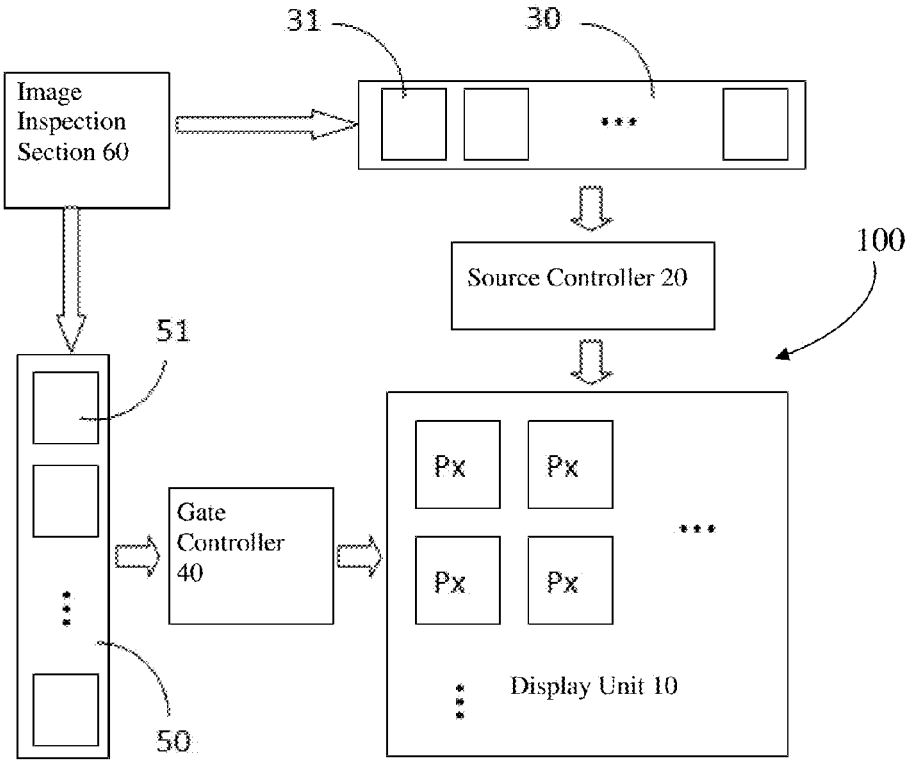
FIG. 6 is a schematic view showing the structure of a liquid crystal panel provided according to an embodiment of the present invention.

As shown in FIG. 6, the liquid crystal panel 100 according to the instant embodiment comprises a display area 10 that comprises an array of pixel units px (of which only a port is shown in the drawing), a source controller 20, a gamma voltage control section 30, a gate controller 40, and a chamfer voltage control section 50. The chamfer voltage control section 50 supplies a chamfer voltage to the gate controller 40 to make the gate controller 40 generating a corresponding scan signal supplied to the pixel units px. The gamma voltage control section 30 supplies a gamma voltage to the source controller 20 to make the source controller 20 generating a corresponding data signal supplied to the pixel units px. Referring to FIG. 6, the liquid crystal panel 100 according to the instant embodiment further comprises an image inspection section 60. The chamfer voltage control section 50 comprises n chamfer voltage circuits 51 and the gamma voltage control section 30 comprises n gamma voltage circuits 31, where n is an integer greater than one (1).

Figure 7:
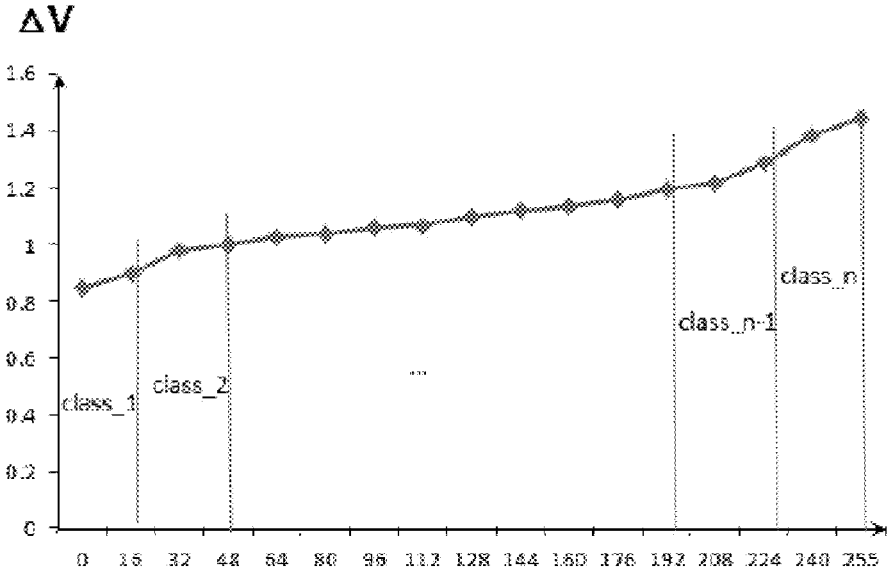
FIG. 7 is a schematic view illustrating classification of images based on the high-low sequence of grey level according to the present invention.

A driving method for the above-provided liquid crystal panel comprises the following steps:

(a) The image inspection section 60 receiving an image signal and divides images into n classes according to ranking of grey levels of the image signal. As shown in FIG. 7, the images are classified, according to the grey level ranking, into class_1, class_2, . . . , class_n-1, and class_n, namely n classes in total. For a frame of image contains some pixels of high grey levels and some pixels of low grey levels, if the number of the pixels of high grey levels is greater, then the frame of image is classified as one belonging to a class of high grey level; and if the number of the pixels of low grey levels is greater, then the frame of image is classified as one belonging to a class of low grey level.

(b) The chamfer voltage control section 50 is operated according to the class of an image to control one of the n chamfer voltage circuits 51 to supply a chamfer voltage to the gate controller 40 to make the gate controller 40 generating a scan signal supplied to the pixel units px. For example, when the image inspection section 60 inspects and identifies an image belonging to the mth class, the mth chamfer voltage circuit of the chamfer voltage control section 50 supplies a chamfer voltage to the gate controller 40.

(c) The gamma voltage control section 30 is operated according to the class of the image to control one of the n gamma voltage circuits 31 to supply a gamma voltage to the source controller 20 to make the source controller 20 generate a data signal supplied to the pixel units px. For example, when the image inspection section 60 inspects and identifies the image belonging to the mth class, the mth gamma voltage circuit of the gamma voltage control section 30 supplies a gamma voltage to the source controller 20.

In the above, n is an integer greater than one (1) and m=1, 2, . . . , n.

Figure 8:
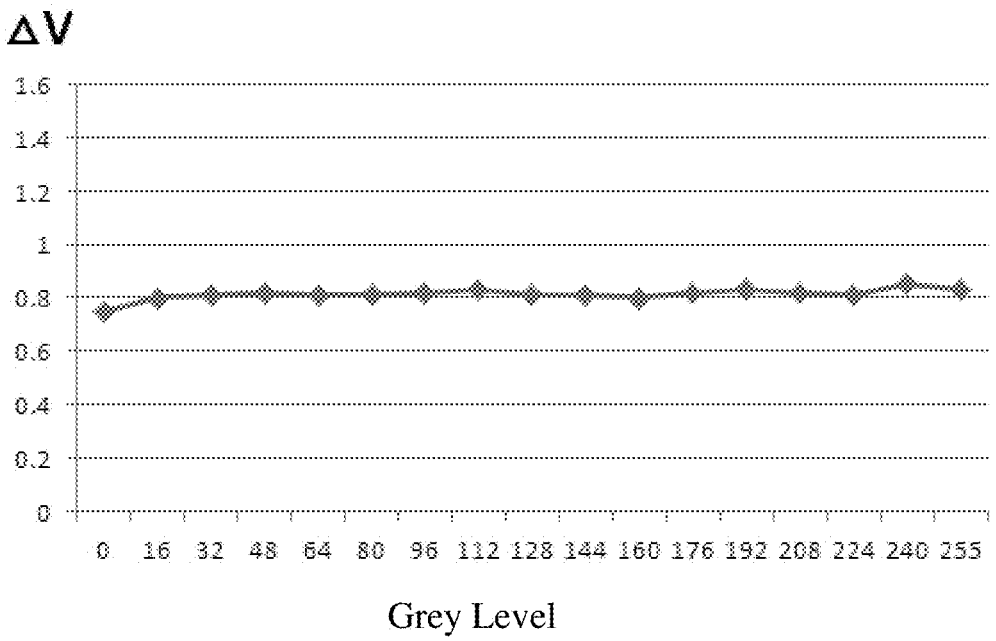
FIG. 8 shows a relationship between a feed-through voltage ΔV and grey level according to the present invention.

When the grey level of an image signal inspected by the image inspection section 60 is higher (namely the image belongs to a class of a higher grey level), the chamber voltage supplied from the chamfer voltage control section 50 gets smaller. As such, when the grey level of an image to be displayed is higher, the chamfer voltage supplied from the chamfer voltage control section 50 is made smaller so that a difference between a turn-on voltage Vgh and a turn-off voltage Vgl is reduced; and when the grey level of an image displayed is lower, the chamfer voltage supplied from the chamfer voltage control section 50 is corresponding larger so that the difference between the turn-on voltage Vgh and the turn-off voltage Vgl is correspondingly enlarged. Through controlling the difference between the turn-on voltage Vgh and the turn-off voltage Vgl for different grey levels, reduction of the difference of ΔV between high and low grey levels within the full grey level range can be achieved and a curve indicating the relationship between ΔV and grey level is shown in FIG. 8.

In the instant embodiment, the n gamma voltage circuits 31 arranged to correspond to the n chamfer voltage circuits 51 in a one-to-one manner. Controlling of each gamma voltage circuit 31 to generate a gamma voltage is based on the chamfer voltage generated by the corresponding one of the chamfer voltage circuits 51.

Figure 9:
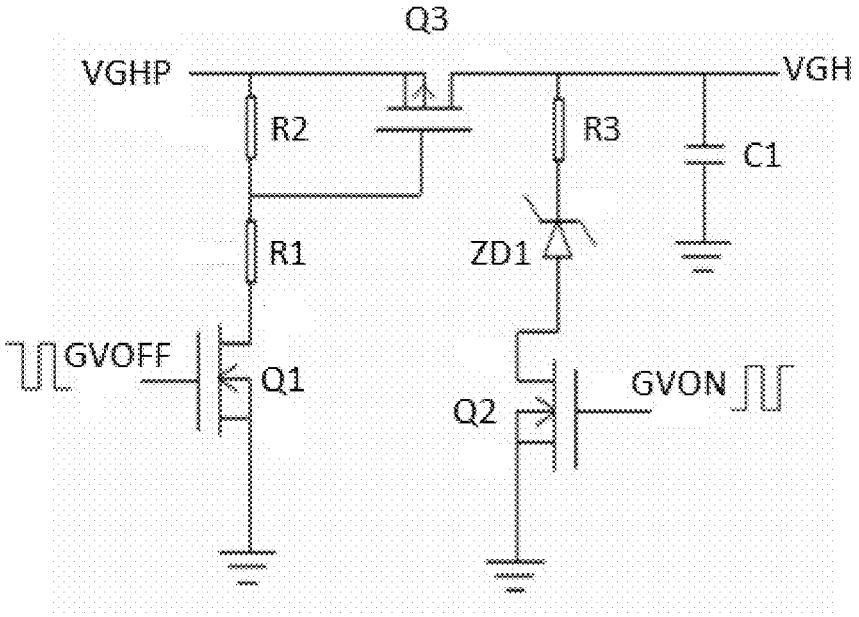
FIG. 9 is a circuit diagram of a chamfer circuit provided according to an embodiment of the present invention.

The chamfer voltage circuits 51 may be arranged as a 3-step circuit. Specifically, a 3-step circuit provided according to the instant embodiment is shown in FIG. 9. The circuit comprises a Zener diode ZD1, a first N-type metal oxide semiconductor (MOS) transistor Q1, a second N-type MOS transistor Q2, and a P-type MOS transistor Q3. The first N-type MOS transistor Q1 has a source terminal electrically connected to ground, a gate terminal connected to a driving signal GVOFF, and a drain terminal connected by a first resistor R1 and a second resistor R2 to a source terminal of the P-type MOS transistor Q3 and receiving a reference voltage signal VGHP. The P-type MOS transistor Q3 has a drain terminal connected to a connection line A and the P-type MOS transistor Q3 has a gate terminal connected to a point between the first resistor R1 and the second resistor R2. The second N-type MOS transistor Q2 has a source terminal electrically connected to ground, a gate terminal connected to a phase-reversed signal GVON of the driving signal, and a drain terminal connected to a positive terminal of the Zener diode ZD1. The Zener diode ZD1 has a negative terminal connected by a third resistor R3 to the drain terminal of the P-type MOS transistor Q3. The connection line A is electrically connected through a capacitor C1 to ground. In the circuit, a chamfer voltage VGH is outputted through the connection line A.

Figure 10:
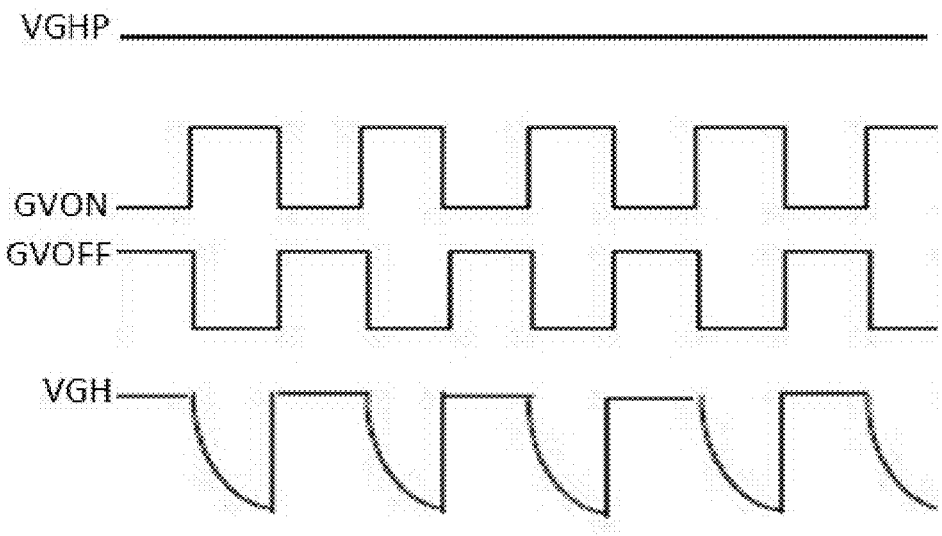
FIG. 10 shows a waveform diagram of signals generated during an operation process of the chamfer circuit illustrated in FIG. 9.

Referring to FIG. 9, together with a waveform diagram illustrated in FIG. 10, an operation process of the 3-step circuit shown in FIG. 9 is as follows:

(1) When the driving signal GVOFF is of a high level, the first N-type MOS transistor Q1 is turned on and the P-type MOS transistor Q3 is turned on; and under this condition, the phase-reversed signal GVON of the driving signal is at a low level so that the second N-type MOS transistor Q2 is turned off, namely the chamfer voltage outputted is VGH=VGHP and no chamfering is applied.

(2) When the driving signal GVOFF is of a low level, the first N-type MOS transistor Q1 is turned off and the P-type MOS transistor Q3 is turned off; under this condition, the phase-reversed signal GVON of the driving signal is at a high level so that the second N-type MOS transistor Q2 is turned on and makes the positive terminal of the Zener diode ZD1 grounded and voltage accumulated in the capacitor C1 is discharged through the Zener diode ZD1 thereby applying chamfering to the outputted chamfer voltage VGH, namely VGH<VGHP. The resistance of the third resistor R3 is used to control the speed of discharging of the capacitor C1 and through adjusting parameters of the Zener diode ZD1, a bottom line of descending of the chamfer voltage VGH can be limited. Thus, for different ones of the chamfer voltage circuits 51, through varying the parameters of the Zener diode ZD1, different chamfer voltages can be obtained.

In summary, compared to the prior art techniques, in the liquid crystal panel provided according to the present invention, classification is made according to ranking of grey level of images based on an inputted image signal and selection of corresponding chamfer voltages and gamma voltages is made according to the classes of the images so that while the feed-through voltage ΔV is reduced, the difference of ΔV between high and low grey levels can also be reduced so as to enhance the displaying quality of the liquid crystal panel.

Although the present invention has been described with reference to the preferred embodiments thereof, it is noted that those having ordinary skills may appreciate improvements and modifications without departing from the principle of the present invention and those improvements and modifications are considered within the scope of protection of the present invention.

What is claimed is:

1. A liquid crystal panel, comprising:

a display area, which comprises an array of pixel units formed thereon;

a gate controller, which supplies a scan signal to the pixel units;

a source controller, which supplies a data signal to the pixel units;

a chamfer voltage control section, which comprises n chamfer voltage circuits to supply a chamfer voltage to the gate controller to make the gate controller generating the scan signal corresponding thereto;

a gamma voltage control section, which comprises n gamma voltage circuits to supply a gamma voltage to the gate controller to make the gate controller generating the data signal corresponding thereto;

the liquid crystal panel further comprising an image inspection section, where the image inspection section, in response to an image signal received thereby, classifies images into n classes according to ranking of grey level of the image signal;

wherein when the image inspection section inspects and identifies an image belongs to a mth class, the chamfer voltage control section is operated to have a mth one of the chamfer voltage circuits supplying the chamfer voltage to the gate controller and the gamma voltage control section is operated to have a mth one of the gamma voltage circuits supplying the gamma voltage to the gate controller;

where n is an integer greater than 1 and m=1, 2, . . . , n.

2. The liquid crystal panel as claimed in claim 1, wherein when the grey level of the image signal inspected by the image inspection section is higher, the chamfer voltage supplied from the chamfer voltage control section is smaller.

3. The liquid crystal panel as claimed in claim 1, wherein the chamfer voltage circuits comprise a 3-step circuit.

4. The liquid crystal panel as claimed in claim 2, wherein the chamfer voltage circuits comprise a 3-step circuit.

5. The liquid crystal panel as claimed in claim 1, wherein the gamma voltage generated by the mth gamma voltage circuit is obtained through an adjustment made according to the chamfer voltage generated by the mth chamfer voltage circuit.

6. The liquid crystal panel as claimed in claim 2, wherein the gamma voltage generated by the mth gamma voltage circuit is obtained through an adjustment made according to the chamfer voltage generated by the mth chamfer voltage circuit.

7. A driving method for the liquid crystal panel according to claim 1, comprising:

the image inspection section receiving the image signal and classifying images into n classes according to ranking of grey level of the image signal;

the chamfer voltage control section being operated according to the classification of an image to control one of the n chamfer voltage circuits to supply the chamfer voltage to the gate controller to make the gate controller generate the scan signal supplied to the pixel units; and the gamma voltage control section being operated according to the classification of the image to control one of the n gamma voltage circuits to supply the gamma voltage to the gate controller to make the gate controller generate the data signal supplied to the pixel units;

where n is an integer greater than 1.

8. The liquid crystal panel driving method as claimed in claim 7, wherein when the grey level of the image signal inspected by the image inspection section is higher, the chamfer voltage supplied from the chamfer voltage control section is smaller.

9. The liquid crystal panel driving method as claimed in claim 7, wherein the chamfer voltage circuits comprise a 3-step circuit.

10. The liquid crystal panel driving method as claimed in claim 8, wherein the chamfer voltage circuits comprise a 3-step circuit.

11. The liquid crystal panel driving method as claimed in claim 7, wherein the n gamma voltage circuits are arranged to corresponding to the n chamfer voltage circuits in a one-to-one manner and the gamma voltage generated by each of the gamma voltage circuits is obtained through an adjustment made according to the chamfer voltage generated by the corresponding one of the chamfer voltage circuits.

12. The liquid crystal panel driving method as claimed in claim 8, wherein the n gamma voltage circuits are arranged to corresponding to the n chamfer voltage circuits in a one-to-one manner and the gamma voltage generated by each of the gamma voltage circuits is obtained through an adjustment made according to the chamfer voltage generated by the corresponding one of the chamfer voltage circuits.

13. A liquid crystal display, comprising a liquid crystal panel and a backlight module, the liquid crystal panel being arranged opposite to the backlight module, the backlight module supplying displaying light to the liquid crystal panel to allow the liquid crystal panel to display an image, wherein the liquid crystal panel comprises:

a display area, which comprises an array of pixel units formed thereon;

a gate controller, which supplies a scan signal to the pixel units;

a source controller, which supplies a data signal to the pixel units;

a chamfer voltage control section, which comprises n chamfer voltage circuits to supply a chamfer voltage to the gate controller to make the gate controller generating the scan signal corresponding thereto;

a gamma voltage control section, which comprises n gamma voltage circuits to supply a gamma voltage to the gate controller to make the gate controller generating the data signal corresponding thereto;

the liquid crystal panel further comprising an image inspection section, where the image inspection section, in response to an image signal received thereby, classifies images into n classes according to ranking of grey level of the image signal;

wherein when the image inspection section inspects and identifies an image belongs to a mth class, the chamfer voltage control section is operated to have a mth one of the chamfer voltage circuits supplying the chamfer voltage to the gate controller and the gamma voltage control section is operated to have a mth one of the gamma voltage circuits supplying the gamma voltage to the gate controller;

where n is an integer greater than 1 and m=1, 2, . . . , n.

14. The liquid crystal display as claimed in claim 13, wherein when the grey level of the image signal inspected by the image inspection section is higher, the chamfer voltage supplied from the chamfer voltage control section is smaller.

15. The liquid crystal display as claimed in claim 13, wherein the chamfer voltage circuits comprise a 3-step circuit.

16. The liquid crystal display as claimed in claim 14, wherein the chamfer voltage circuits comprise a 3-step circuit.

17. The liquid crystal display as claimed in claim 13, wherein the gamma voltage generated by the mth gamma voltage circuit is obtained through an adjustment made according to the chamfer voltage generated by the mth chamfer voltage circuit.

18. The liquid crystal display as claimed in claim 14, wherein the gamma voltage generated by the mth gamma voltage circuit is obtained through an adjustment made according to the chamfer voltage generated by the mth chamfer voltage circuit.

* * * * *